United States Patent [19]

Pichler

[11] Patent Number: 4,749,976

[45] Date of Patent: Jun. 7, 1988

[54] SOLENOID

[75] Inventor: Josef Pichler, Ebreichsdorf, Austria

[73] Assignee: Mannesmann Tally GmbH, Vienna, Austria

[21] Appl. No.: 913,066

[22] Filed: Sep. 29, 1986

[30] Foreign Application Priority Data

Sep. 28, 1985 [EP] European Pat. Off. ..... 85112335.6

[51] Int. Cl.[4] ..... H01F 7/08

[52] U.S. Cl. ..... 335/257; 335/271; 335/277

[58] Field of Search ..... 335/257, 258, 262, 271, 335/274, 277

[56] References Cited

U.S. PATENT DOCUMENTS

Re. 31,813 1/1985 Fugate et al. ..... 335/271

3,675,172 7/1972 Petusky ..... 335/277

4,463,332 7/1984 Everett ..... 335/274

FOREIGN PATENT DOCUMENTS 1806245 3/1970 Fed. Rep. of Germany ..... 335/274

*Primary Examiner*—George Harris

*Attorney, Agent, or Firm*—Ralf H. Siegemund

[57] ABSTRACT

A solenoid-type magnet drive, including a coil surrounding in parts an axially movable armature, and a housing for mounting the coil, further includes an attenuating device which comprises an attenuating disk positioned abutting centrally one end of the armature, when in a retracted position; two resilient rings hold the disk near its periphery and without play for preventing rebounding.

9 Claims, 2 Drawing Sheets

SOLENOID

BACKGROUND OF THE INVENTION

The present invention relates to a solenoid-type electromagnet for operating frequencies in the order of magnitude of about 3000 cps and higher, and more particularly, but not exclusively, the invention relates to a solenoid drive for print needles or styli in matrix printers, wherein the needles or styli or actuating elements for the needles or styli are fastened, respectively, to an axially movable armature.

Solenoid type electromagnets and drive magnets to which the invention pertains usually include some form of attenuation structure in order to reduce any shock effect such as any sudden stoppage of the magnet may entail. Solenoid magnets of this type are often used, generally, in electrical engineering and may include structure for driving various kinds of equipment such as switches, circuit brakers, etc. Such solenoid magnets are, therefore, often used in electric circuits generally as actuators for purposes of changing the state of connection within a particular circuit or for the transmission of a signal or the like. As stated above, the electromagnets of this type are particularly used in matrix printers, particularly matrix line printers, but also in so-called serial matrix print heads.

German printed patent application No. 18 06 245 discloses a solenoid type electromagnet with the principle task to obtain a high operating and switching frequency at lowest possible weight of the movable elements; the magnet or armature as such is to be of light weight; or generally the parts that are actually subject to high speed movement, particularly high speed acceleration and deceleration should be as light as possible. In addition, the attraction forces have to be adequately high. The known solution to this problem, i.e. the known solution towards providing an electromagnet for high switching and operating frequencies, is to be obtained through minimal outer dimensions as far as the respective magnet is concerned, and by combining that feature it with an optimized force-mass-ratio. This way, an attempt was made, to indeed, provide a specific solution to the problem in so-called mosaic printers. The specific solution to the problem found in that reference is then a particular construction of the movable armature.

The various aspects taken into consideration in this publication, however, fail to realize that in the case of high switching and operating frequencies, the armature often has to be stopped in an extreme short period of time so that the new current pulse can be built up. This stopping of the armature toward the end, for example, of a retraction stroke, requires particular attenuation structure. Rebounding cannot be tolerated at a time when a new energization of the magnet may commence!

DESCRIPTION OF THE INVENTION

It is an object of the present invention to provide a new and improved solenoid-type magnet for switching or operating frequencies in the range of 300 cycles and higher, and to improve such a solenoid through a particular attenuating structure, to avoid rebounding as much as possible, particularly on retraction of the armature.

In accordance with the preferred embodiment of the present invention, it is therefore suggested to provide an attenuator which includes at least one separate, attenuating element, e.g. a disk which abuts the solenoid armature when in a resting position while the attenuating element is mounted between two resilient annular elements outside (e.g. radially displaced from) the area of abutment and without play. In practice it was found, particularly through experiments, that such an attenuator will, indeed, prevent rebounding of the armature at frequencies in the range of 3,000 cps and higher. Particularly in the case of very small armature strokes, such as 0.3 mm being equivalent to a particular oscillating amplitude, the armature will not rebound after following stoppage. This is very important because in the past rebounding could amount to almost a complete normal operating strokes including a forward motion of the print needle, up to the point of printing another dot. Also, the firing of the needle during periods of rebounding while the needle is at rest, is avoided. It was found, moreover, that such an attenuation in terms of total operating cycles, is able to withstand printing of several hundred million dots or symbols.

The desired oscillation, and particularly the temporal characteristic of the normal operating oscillation can be assured by making the attenuating body from a metallic disk and the solenoid armature is constructed, at least in the area of abutment against the attenuating structure, from a synthetic material. The cooperation of the metallic attenuation disk, on one hand, and the partially synthetic construction of the armature, was found to be particularly useful for attenuating and actually suppressing any rebounding effect on retraction of the armature. Optimum attenuation can be obtained if the attenuating body as such has a mass that is a multiple of (i.e. at least twice) the mass of the armature. Such an armature will then be ideally attuned to the mass of the attenuating bonding, as far as operating frequencies, on one hand, and the mass that has to be moved, on the other hand, are concerned.

It should be realized that, in fact, contradictory requirements are to be met, namely to impart upon an armature magnetic properties, which require simply a particular amount of magnetizable material, but, on the other hand, for reasons of rebounding prevention the mass of the armature is to be made as low as possible. In addition, it seems to be contradictory to provide the armature in the attenuating region, with resilient or elastic properties. Such a compound body (synthetic plus magentizable metal) can be made in that the armature proper is comprised basically of a holder for the print needle; parts of the print needle and the holder are surrounded by, i.e. embedded in, the synthetic which defines the aforementioned abutment surface against the attenuating disk. A magnetic, i.e. magnetically conductive, armature shaft, or better, sleeve, is then added on to this synthetic part. Preferably then, the magnetically conductive part of the armature construction as a whole should have a minimum in mass.

The required accurate movement of the armature is, in furtherance of the invention, improved in that a flux ring or yoke ring surrounds the electromagnetic coil which penetrates the armature sleeve, and a support and guiding ring is fastened to this flux or yoke ring, whereby the center opening of the support and guiding ring guides the armature shaft. This proposed construction is of advantage because a retraction spring can be provided between the armature and the support ring; the spring bears against a synthetic shoulder of the armature as well as an axial face of the support and guiding ring.

The invention, moreover, permits a clear-cut separation of functional groups, namely an electromagnetic drive group generally, being separated from the attenuating structure. Another improvement is to be seen in that the magnetic yoke, a tube surrounding the electromagnetic coil and serving as a housing, the magnetic flux ring and the armature shaft or sleeves, are all made of an iron-silicon alloy.

DESCRIPTION OF THE DRAWINGS

While the specification concludes with claims particularly pointing out and distinctly claiming the subject matter which is regarded as the invention, it is believed that the invention, the objects and features of the invention, and further objects, features, and advantages thereof will be better understood from the following description taken in connection with the accompanying drawings in which:

Figure 1:
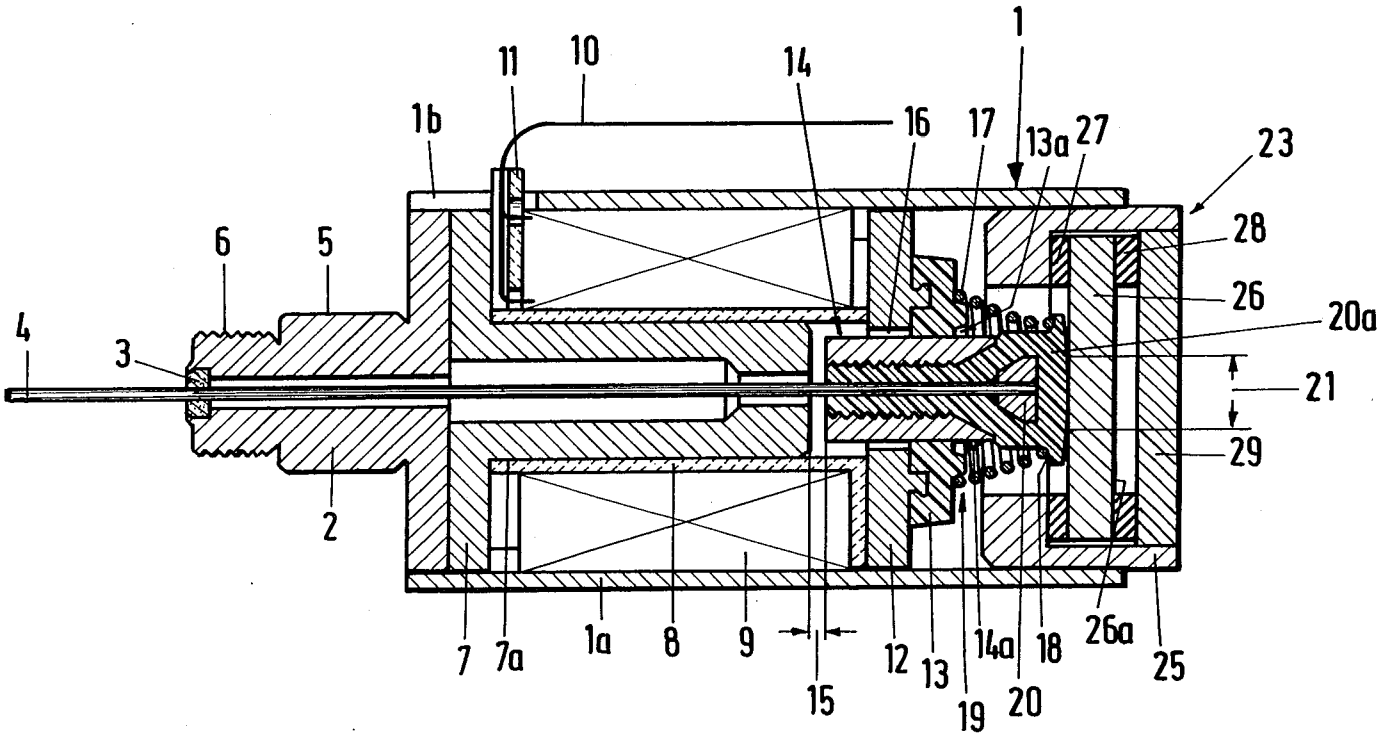
FIG. 1 is an axial, longitudinal view through an electromagnet of the solenoid variety and being constructed in accordance with the preferred embodiment of the present invention for practicing the best mode thereof.

Proceeding now to the detailed description of the drawings, the solenoid-type electromagnet 1 shown in the figures is assumed to serve as a drive for a print element such as a print needle 4, and it is further assumed generally that 4 is an operating element within a matrix line printer. Alternatively, the same or a similar kind of construction can be used in a serial type matrix print head. In the case of matrix line printers, typically there are maybe sixty such electromagnets mounted on a shuttle, or even more, for movement in horizontal direction, i.e. in parallel to a printing platen, and all the print needles such as 4 are very accuratley aligned in a horizontal plane. Moreover, they are all very accurately equidistantly spaced. Accuracy here reflects directly in the appearance of whatever is being printed. In the case of a serial type matrix print head, the solenoid-type electrogmagnets are arranged in a polygonal-type cluster, whereby, depending on the sophistication 7, 9, 18, and/or even 24 such solenoids are clustered in the head.

The housing of the solenoid 1 is constructed from a tubular element or sleeve 1*a*, having an outer diameter, for example, of 10 mm. The drawing is, therefore, considerably enlarged. The front end of this housing 1 is provided with a holder 2 for a ruby 3 which guides the print needle 4. The holder 2 is connected with or constructed as a centering shaft 5 by means of which the entire electromagnet is inserted into the shuttle of a matrix line printer, and centered accordingly. The fastening is obtained through a threading 6 on a shaft section 5.

A magnetic yoke 7 is disposed behind the holder 2 in the housing 1. A sleeve-like extension 7*a* of yoke ring 7 carries an electrically insulating core 8, and the latter, in turn, carries an electromagnetic coil 9. One can also say that the sleeve-like extension 7*a* is stuck into the coil/-core combination 9/8. Reference numeral 10 refers to a current feed for the electromagnetic coil 9, to supply thereto current pulses. Slot 1*b* in the housing 1 permits to run the feeder line 10 from the outside into the housing and along an insulating piece coil end 11, towards the ends or terminals of the coil 9.

The right-hand flange or end of the non-magnetic core 8 bears against a magnetizable flux ring 12 which, in turn, support a guiding ring 13 made of magnetically non-conductive material, e.g. a synthetic. Support and guiding ring 13 is provided for supporting on its inside an armature 14, which is provided for movement in axial direction in the opening of ring 13. The magnetic yoke 7, the tube 1*a*, surrounding the coil 9, the flux ring 12, as well as a sleeve 14*a* that is a part of the armature, are all made of a silincon-iron alloy and, thus, so to speak, are easily and speedily magnetizable.

The right-hand and front end of the sleeve 7*a* as extending from the magnetic yoke, and the front, left-hand end of the armature 14, provide a primary (axial) gap 15, which is about 0.325 mm wide whenever the coil 9 is not energized. The sleeve 14*a* and the ring 12 establish an invariable secondary (radial) gap 16. The armature 14 is biased by a retraction coil 17 for returning the armature, on the decay of each current pulse, to the rearward retracted position, which is the one illustrated. The retraction coil 17 is a conical coil spring which bears against a step flange or collar 18 of the armature, as well as against a step 19 on the mounting ring 13.

Figure 2:
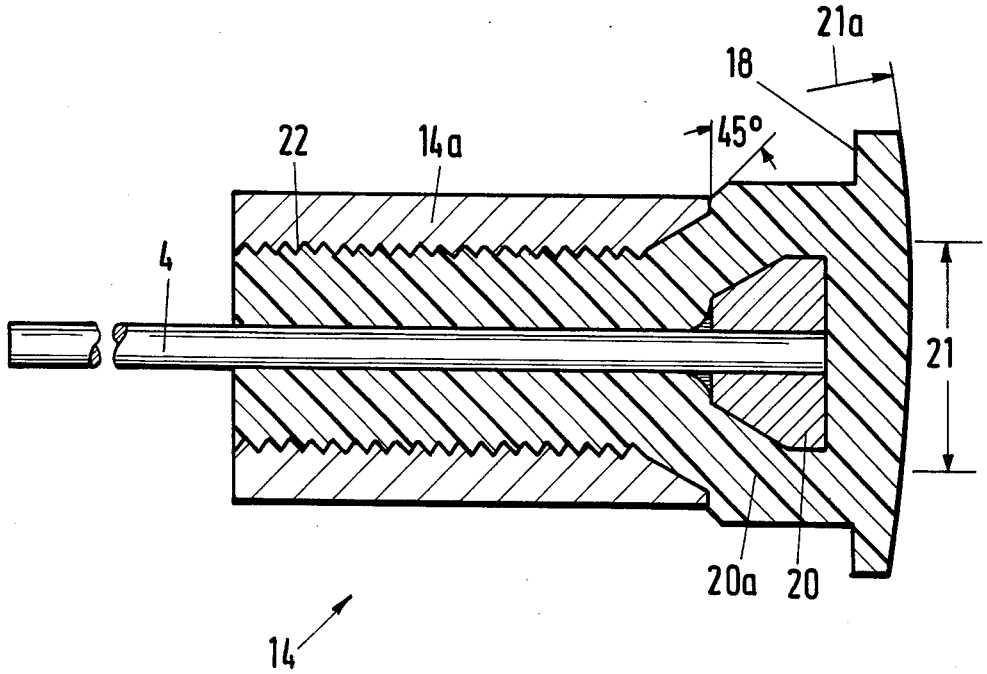
FIG. 2 illustrates an enlargment of a portion of the device shown in FIG. 1, illustrating particularly a longitudinal view through the armature as a print needle operating element.

FIG. 2 illustrates specifically the armature 14 in an enlarged scale. Herein one can see that the armature 14 is provided with a holder 20, which is surrounded by and embedded in a synthetic part 20*a*. Generally, at least that portion of the armature that defines the abutment surface 21, is made of a synthetic material. This is a basic aspect of the present invention. The entire end-/surface of the armature is convex, i.e. it is curved as indicated by a radius 21*a*. The abutment part 21 of that surface results from the retracting action of the armature on account of spring 17, there being a certain flattening of that armature end as against disk 26.

The print needle 4 is secured to the metallic holder 20. The connection may be provided, for example, through soldering. Impact energy is, therefore, transmitted upon and by the synthetic part 20*a* for transmission of such impact energy from the holder 20, and from there upon the needle 4 or any other actuating element.

In this particular embodiment the synthetic part 20*a* is extended beyond the solenoid armature stop or shoulder 18 into the armature sleeve 14*a* and is connected thereto by means of a threading 22. Armature sleeve 14*a* is guided and held in a central opening 13*a* of the bearing ring 13 as already stated. The armature 14, constructed as described, can be operated at a frequency of 3,000 cps, on account of being attenuated as follows.

Facing the armature 14 in FIG. 1, an attenuating assembly 23 is provided in the housing. The attenuating device structure is contained in an annular casing 25 and includes at least one separate attenuating body 26 being flat but a fairly thick disk. This disk is held radially outside of the effective abutment surfaces 21 of the armature, and without play between two elastic ring elements 28 and 27. The axially outer ring element 28 is held by means of cover 29 and can, possibly, be biased by means of that cover. The attenuating disk or element 26 is made as a circular metallic disk and has a mass which is a multiple of the mass of the armature 14. By way of example, and typically, the mass of the disk 26 may be twice the mass of the armature 14. The effect of this attenuating device and assembly 23 is to be seen in the following.

A complete oscillation of the armature is comprised of a forward stroke and of a retraction or return stroke by the armature 14 and that retraction is terminated without rebounding, that is to say, the armature 14 with needle 4 will come to a complete stop in an extremely short period of time, right at the end of a return stroke. Thus, the armature can be reactivated much earlier than possible if rebounding were to occur. the attenuating effect is practically completely extended into the next full operating cycle, and that is, in fact, the reason a relatively high operating frequency of 3,000 cps can be employed without interposing any additional attenuating period in between any two activation cycles.

The invention in particularly applicable in cases of matrix line printers because the total weight of the armature and electromagnet actuator parts is very low, and even though there is a large number of them, the total mass of the shuttle together with all magnets and the armatures is not that high, which means that specifically the number of solenoid elements does, in fact, not increase significantly the mass of the shuttle as a whole. Even more favorable conditions obtain in the case of a serial matrix print head which usually does not have more than 24 such solenoids.

The invention is not limited to the embodiments described above, but all changes and modifications thereof, not constituting departures from the spirit and scope of the invention, are intended to be included.

I claim:

1. A solenoid-type magnet drive, including coil means surrounding in parts an axially movable armature, and a housing for mounting the coil, further including an attenuating device comprising:

a freely movable attenuating disk and being positioned for abutting one end of the armature when in a retracted position, the abutment occurring in essentially a central area of the disk; and two resilient rings radially displaced from said area of abutment and holding said disk in between without play and in said casing, to provide attenuation for preventing rebounding of said solenoid upon retraction of the armature.

2. The device as in claim 1, wherein said attenuating disk is made of metal and said armature in an area of abutment being made of a synthetic material.

3. The improvement as in claim 1, wherein said attenuating disk has at least twice the mass of the armature.

4. The improvement as in claim 1, wherein said armature is comprised of a holder for an actuating element, said holder being embedded in a synthetic part whose one end surface abuts said attenuating disk, there being a magnetically conductive armature sleeve, mounted on said synthetic part.

5. The device as in claim 4, and including a magnetic flux ring, abutting and axially continuing said electromagnetic coil, said armature sleeve traversing said flux ring, and a mounting ring on said flux ring surrounding said sleeve and centrally guiding the same during movement of the armature.

6. The device as in claim 5, and including a recoiling spring disposed between said armature and said mounting ring bearing.

7. A solenoid drive for print needles in matrix printers, there being a coil, a housing for mounting the coil, and a mouth piece in the housing for guiding said print needle, an armature construction and attenuating arrangement comprising:

a magnetizable sleeve;

a synthetic material part inserted in said sleeve, one end of said print needle being embedded in said synthetic part, said synthetic part having an axial end and abutment surface; and a metallic disk having a central portion for abutting that synthetic part when the solenoid is un-energized, there being two elastic rings radially displaced from that synthetic part and engaging for holding opposite sides of said attenuating disk, playfree in said housing.

8. In the combination with the arrangement as in claim 7, there being a magnetizable disk with relatively wide aperture surrounding said sleeve-like armature and being mounted on an axial end of said coil, said ring carrying a synthetic material, guide disk, in which said sleeve slides.

9. The combination as in claim 8, there being a conical retraction spring for the armature, bearing with one end against a shoulder of said synthetic part near the abutment surface thereof, and with its wide conical end against said guide disk.

* * * * *